US006027264A

United States Patent [19]

Maher et al.

[11] Patent Number: 6,027,264

[45] Date of Patent: Feb. 22, 2000

[54] FIXTURELESS, ACCURATE SYSTEM AND ASSEMBLY METHOD FOR CONTROLLING PEN-TO-PAPER SPACING IN AN INKJET PRINTER

[75] Inventors: Edward P. Maher, Oceanside; Darren W. Wilcox; Dan Scott Caputo, both of San Diego, all of Calif.

[73] Assignee: Hewlett-Packard Company, Palo Alto, Calif.

[21] Appl. No.: 09/024,976

[22] Filed: Feb. 16, 1998

[51] Int. Cl.[7] ..... B41J 25/308

[52] U.S. Cl. ..... 400/55; 400/56; 400/59; 400/58; 347/37

[58] Field of Search ..... 400/23, 55, 56, 400/57, 59, 355, 58; 347/37

[56] References Cited

U.S. PATENT DOCUMENTS

| | | | |
|---|---|---|---|
| 4,773,773 | 9/1988 | Itoh | 400/59 |
| 4,906,115 | 3/1990 | Bischof | 400/55 |
| 5,000,590 | 3/1991 | Einem | 400/55 |
| 5,678,936 | 10/1997 | Hino | 400/55 |
| 5,692,842 | 12/1997 | Sasai et al. | 400/59 |
| 5,700,095 | 12/1997 | Sugiyama | 400/55 |

FOREIGN PATENT DOCUMENTS

| | | | |
|---|---|---|---|
| 37 37 499 | 5/1989 | Germany | 400/55 |
| 60-6490 | 1/1985 | Japan | 400/59 |
| 60-154091 | 8/1985 | Japan | 400/59 |
| 61-29574 | 2/1986 | Japan | 400/55 |

*Primary Examiner*—Christopher A. Bennett

[57] ABSTRACT

Both a printing-medium support (such as a platen) and a printhead-carriage slide-rod are supported and located in common from a single chassis. Preferably a pair of positive stops is used to locate the slide-rod, and a biasing retainer forcibly abuts the rod against, selectively, either stop of the pair of positive stops. Alternatively the two positive stops are instead used to locate the print-medium support—or separate pairs of such stops are used to locate both the slide-rod and the print-medium support respectively. A respective biasing retainer forcibly engages each located support element against one or the other of its stops. In another facet of the invention, an accurate system establishes and adjustably controls printhead-to-print-medium spacing without an assembly fixture. An adjustable mechanism (such as the biasing retainer mentioned above), distinct from both support elements, locates one of the two supports relative to the other. The mechanism includes components that enable adjustment to control the spacing between the printhead and the printing medium—but these adjustment-enabling components contribute zero uncertainty to the spacing. The assembly method includes positioning the slide-rod with its two ends in respective oversize mounting holes of a chassis, and attaching to each end of the slide-rod a respective retainer to force the slide-rod end in one of exactly two opposite directions against the mounting-hole edge.

26 Claims, 6 Drawing Sheets

10
11
12
14
15
16
19
19'
20
23
35
40'
44'
45'
5
5''
6
6''
51
54
55

FIG. 9
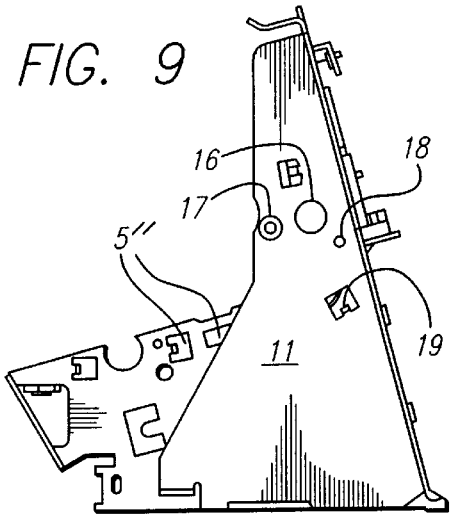
FIG. 10
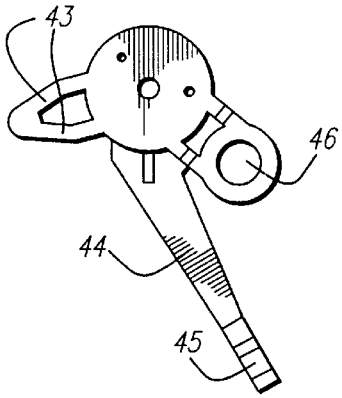
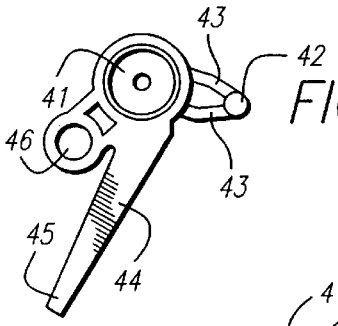
FIG. 11
FIG. 12
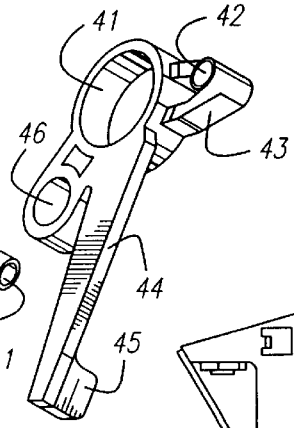
FIG. 13
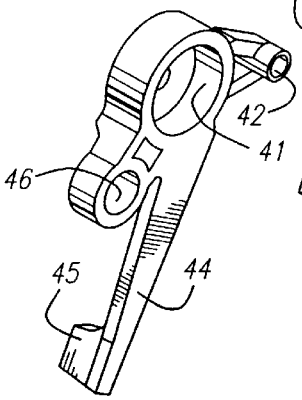
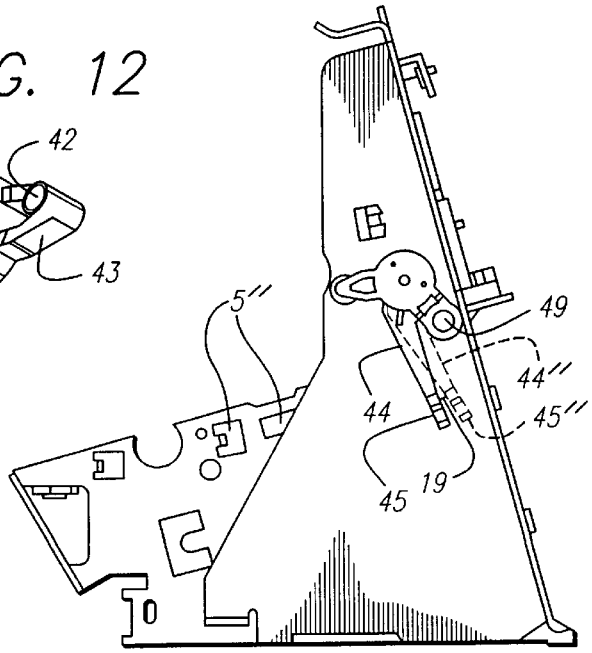
FIG. 14

FIXTURELESS, ACCURATE SYSTEM AND ASSEMBLY METHOD FOR CONTROLLING PEN-TO-PAPER SPACING IN AN INKJET PRINTER

RELATED PATENT DOCUMENT

A closely related document is another, coowned and copending U.S. utility-patent application, hereby incorporated by reference in its entirety into this document. It is Ser. No. 08/684,736, filed Jul. 22, 1996, in the names of Juehui Hong et al., and entitled "INTEGRATED SHELL-AND-CHASSIS CONSTRUCTION FOR A DESKTOP IMAGE-RELATED DEVICE"—and issued as U.S. Pat. No. 5,775,825 on Jul. 7, 1998.

FIELD OF THE INVENTION

This invention relates generally to machines that print images on printing media such as paper, transparency stock, or various other glossy media; and more particularly to a scanning inkjet machine that constructs text or pictorial images from thousands of individual inkdrops sprayed onto a printing medium—and also to a method for making such a machine. The invention may have application in printers of certain other types, such as for instance wax-transfer or dye-sublimation units, to the extent that they are susceptible to spacing sensitivities analogous to those introduced below.

(The word "scanning" in this document refers to the transverse motion of printheads across a printing medium. It is to be distinguished from the same term as used to mean acquiring an image optically from an original document, as in a so-called "scanner" or facsimile machine.)

BACKGROUND OF THE INVENTION (a) Importance of PPS—Achievement of sharp, clean images in inkjet printing requires that the distance between each inkjet printhead or "pen" 30, 30' (FIG. 1) and the paper or other printing medium 2 be controlled very stringently. As is well known, in an inkjet printer a central processor 80 selectively fires the pen nozzles during scanning 32, 32', to form the desired images on the print medium. (In the drawing the printheads are represented conceptually as pens 30 ejecting ink 31 while traveling leftward 32, and also as pens 30' ejecting ink 31' while traveling rightward 32'. These separate representations in the drawing represent the same, identical pens but merely scanning in opposite directions.)

The spacing between the pen and the print medium is called pen-to-paper spacing (or printhead-to-printing-medium spacing) and abbreviated "PPS". It is a critical parameter because the quality of a printed image is greatly affected by relatively small changes in PPS. One reason is that the character of inkdrops 31, 31' in flight—and the resulting ink-spot size—change dramatically with distance of flight.

Another reason is that the rapid scanning motion 32, 32' of inkjet pens, during inkdrop ejection, interacts with the PPS to modify the accuracy of ink-spot placement. The combined effect is a great variation in the size and registration of ink spots formed on the printing medium by pens ejecting ink of different colors—and even by the same pen when traveling in opposite directions 30, 30'.

In modern inkjet systems the pens 30, 30' are coupled 1, 3 to an optoelectronic sensor 37 that monitors fiduciary markings along a scale 38, sending electrical signals 39 to the central processor 80 for development of position and speed information. Some but not all inkjet systems servocontrol the scanning speed to make it constant at all times when the pens are ejecting ink to form an image. To the extent that speed variation is permitted, yet another variable function of the PPS is introduced—i.e., as between pens traveling in the same direction but at different speeds.

Because of these several sensitivities to small PPS changes, in systems with which we are most familiar the overall permissible variation of PPS for optimum print quality is less than ±0.4 mm (about ±0.015 inch).

(b) Economics of PPS control—Special devices and techniques are commonly used, and heretofore have been considered necessary, to control this parameter in a high-volume manufacturing environment. Two common requirements, in particular, are for special adjusting tools—used in a painstaking, time-consuming procedure at an initial measurement/adjustment station on the assembly line—and also a later PPS verification station further along the line. Some printers require a special fixture to measure and adjust PPS. The fixture is complex and must be closely monitored and maintained.

All such provisions are costly in terms of initial hardware capital equipment to establish each new production line in different parts of the world, and also in terms of ongoing labor to staff and supervise these production stations. As will now be clear to a person skilled in this field, PPS control heretofore has been expensive. It has furthermore been less than completely successful.

(c) Mechanics of PPS control heretofore—During printing, inkjet pens are held and transported across a printing-medium page by a scanning carriage 20 that slides on bushings along a support-and-guide rod 6, usually called the "slide-rod". (In FIG. 1 the carriage and rod are represented in common simply by a dashed line 20, 6.)

The rod is supported by a chassis element 10. The central processing unit 80 provides position and speed signals 34 to a motor 35, which operates an endless belt 36 to drive the pen-holding carriage 20 along the rod 6.

The printing medium 2, meanwhile, typically is held and located to a chassis element 10' by a platen 7. In the drawing, the platen is represented for conceptual purposes as a classical typewriter-style rotary platen—with a shaft 51 that is rotatably mounted to the chassis element 10' (as symbolized at right)—and the processor 80 provides electrical signals 53 to a motor 52 that drives the shaft 51. While our invention encompasses such a system, we prefer a different kind of platen and printing-medium drive as will be seen.

In some devices the chassis elements 10, 10' locating the pen carriage and platen respectively have been separate elements fastened together. In other devices they have been neighboring portions of a common chassis.

PPS naturally is controlled by the distance between the pens 30, 30' and the platen 7, and is subject to variation on account of accumulated tolerances between the pens and platen. Key to this accumulation of errors is the relative positioning of the slide-rod and platen to their respective supporting chassis elements, as well as the relative positioning of those chassis elements to each other.

Most inkjet systems heretofore have been designed with an incorporated adjustment mechanism to enable all the accumulated errors to be, in effect, removed by an assembly worker on a production line. In purest principle such adjustment may be taken in the relative positioning of either the platen to the chassis, or the pen (particularly the slide-rod) to the chassis.

The platen, however, is subject to other relatively rigorous constraints by virtue of the interaction of the printing medium with other components in the print-medium advance path. Therefore in many systems adjustment at the platen is disfavored.

Typically therefore it is the slide-rod that has been secured to the chassis through the intermediary of an adjustment system—which heretofore has provided either multistep or continuous (sometimes called "infinite") adjustment. When such an adjustment system has not yet been adjusted or secured at any particular adjustment position, the PPS is typically free to vary a great deal. In many systems it can vary by several times the acceptable variation of PPS.

Consequently satisfactory operation relies totally upon correct adjustment, stabilization and performance of the adjusting system. Furthermore, tolerances contributed in the adjustment devices themselves can consume the entire acceptable PPS variation.

Stabilization of PPS adjustments in general has been accomplished using fasteners that directly lock an adjustable element in place. Torque-type fasteners are especially difficult to control in a PPS system, because every time a fastener is driven, torque transmitted throughout the printing-machine structure inevitably affects PPS. This is particularly important in view of the small (±0.37 mm) window within which inkjet print quality is optimized.

Prior systems are also characterized, in general, by relatively high parts count—a relatively large number of standard fasteners as well as special fittings. It is well known that each incremental fastener or other part to be interconnected correctly in an assembly-line environment tends to add significantly and undesirably to production cost.

(d) Examples of prior systems—The following printers all employ a slide-rod and a carriage assembly, in addition to the parts mentioned below.

A certain portable Canon printer has a sheetmetal chassis, three screws, two springs, and an adjustable bar. A screw is used to provide axial support of the slide-rod. Driving this screw inevitably moves the rod and affects PPS. The Canon PPS adjustment also uses two screws to secure an adjusting rod in place: torquing down these screws shifts the PPS adjustment from its intended position.

As another example, a certain Epson printer has six sheetmetal chassis, more than ten screws, and two adjustable caps. There are so many chassis parts (six) and associated screws to interconnect them, as well as screws in each of two adjustable cap parts, that substantial distortion appears unavoidable. This would suggest a high rate of intervention to adjust PPS. That adjustment is performed by rotation of plastic caps that fit on the ends of the slide-rod and connect to the chassis via a hub and the two screws mentioned above.

Still another example is a printer from the Hewlett Packard Vancouver Division, which has three sheetmetal chassis, four screws and two adjustable caps. The four screws are used to secure the three chassis members together. The associated deformation would affect PPS.

Critical components of that system are the printer chassis 110 (FIG. 20), left endcap 140, endcap pivot point 142, and two-sided cam 118 for shifting the slide-rod location 116—and of course corresponding parts (not shown) at the right end of the chassis 110. This device offers continuous adjustment, so that PPS can be set to exactly the optimal desired value.

Torquing a lock-screw through the locking hole 146 provided in the cam plate 140 to secure the adjustment, however, is likely to disturb the slide-rod position 116 as well as introducing stress and offset into the mechanism generally. As will be understood, it is not our purpose to unduly derogate the illustrated system—as that system is itself not only useful but also a substantial improvement and advance relative to the general state of the prior art—but rather only to point up areas where room for improvement is present in theory. This illustrated HP system is discussed further in section (f) below.

The overall parts count is nine for the Canon, twenty for the Epson, and eleven for the illustrated Hewlett Packard printer.

Yet another Hewlett Packard product, the DeskJet Portable, has taken an opposite approach, namely provision of no adjustment capability at all—thereby wholly avoiding the considerable cost of parts and labor for adjustment. A drawback of this approach is that some small number of production machines must be scrapped or reworked, at very disproportionately high cost.

As shown by the foregoing discussion, heretofore some relatively advanced features have been found only in portable units—of both the Canon and the Deskjet product lines. True desktop machines, by contrast, have been denied the benefits of both a common chassis support for the platen and slide-rod, and positive (though unadjustable) mating of the slide-rod to the chassis. These differences may arise mainly from the lower cost and greater ruggedness required of a portable printer, rather than greater sophistication in design.

(e) Production tooling—In the above-mentioned Canon product, two screws secure an adjusting bar in position. Proper placement of that bar must be accomplished through production-line tooling. Essentially another part, the PPS tool, is introduced that requires careful control and calibration—and which in turn add more variation to the adjustment.

We do not know what tooling may be needed for PPS adjustment in assembly of the above-discussed Epson printer. In the illustrated prior Hewlett Packard printer two rotating plastic caps are positioned through use of assembly tooling, primarily a measurement nest that requires a tool to comfortably rotate the caps.

(f) Chassis design—In this regard the Canon product represents a relatively advanced design. It has a single sheetmetal member to hold all contributors to PPS variation and adjustment, and its chassis supports both the slide-rod and the platen.

The Epson unit, in contrast, employs so many chassis parts (six) that the worst-casing loop for PPS tolerance becomes unnecessarily cluttered. Contributors to PPS variation are not held in reference to each other by a single chassis part. In addition, the slide-rod is located by the caps that rotate to adjust PPS, rather than by a chassis part; this needlessly introduces the component variations of the caps themselves into the tolerance loop for both default and adjusted PPS. It also leaves the rod supported by the cap, risking failure in abusive situations such as mechanical shock and vibration.

The prior HP printer, though not to the same extent as the Epson product, uses multiple chassis parts (three). Contributors to PPS variation are not held in reference to each other in a single chassis part. It too includes the adjustable cap parts in the tolerance loops. As can be seen from the operating relationships of this mechanism (FIG. 20), accuracy of the resulting slide-rod positioning is affected by dimensional instabilities in the cam 118, 119 radii. (If the scale fiducial markings are treated as absolute values, rather than by use of an independent standard measuring device, then the slide-rod position is affected by tolerances in the cam and scale 119, too.) In addition, as mentioned earlier, torquing of a fastener in the securing hole 146 is likely to displace the setting from the chosen value.

(g) Carriage assembly and orientation—Bushings used to enhance sliding motion of the carriage along the slide-rod are a source of PPS error. This error stems in part from tolerances in bushing dimensions, but more importantly from misalignment, other mispositioning, and deformation that all arise as bushings are pressed into the carriage body.

The Canon configuration perhaps represents an effort to avoid imprecision contributions from these sources by using no bushings, although naturally the carriage-molding process is itself subject to imprecision. It also has, near the top of the carriage, a more complex secondary support—that could be subject to greater variation and thus affect PPS.

Also the PPS adjustment in the Canon configuration rotates the carriage—and therefore the printhead nozzle plate. Print-quality errors could result without the addition of some sort of calibration describing the rotation of the nozzle plate, since one end of the plate is further from the paper than the other. No such calibration is apparent in the product, and would be difficult on an assembly line.

The illustrated prior Hewlett Packard printer is manually assembled. It is therefore subject to additional tolerances which also are typically difficult to characterize and counteract.

(h) Conclusion—In offering the foregoing comparative discussion of existing PPS-control configurations it is our intention only to highlight some important considerations, and not to criticize earlier efforts as these have created worthwhile and eminently usable consumer products. Nevertheless some of the limitations discussed have continued to impede achievement of uniformly excellent inkjet printing at an optimal cost. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is inkjet printing apparatus for forming an image on a printing medium as an array of inkdrops. The apparatus includes a chassis.

It also includes a platen for supporting the printing medium from the chassis, and an inkjet printhead for ejecting inkdrops. Also included are a printhead carriage, and a carriage slide-rod, for supporting the printhead from the same chassis.

The apparatus further has a mechanism for locating from the chassis either (a) the platen, or (b) the carriage and slide-rod, or (c) both. The mechanism includes, for each of said platen, or carriage-and-slide-rod, or both:

exactly two positive stops for use in locating said platen, or said carriage and slide-rod, or both, relative to the chassis; and an endcap for forcibly abutting said platen, or said carriage and slide-rod, or both, against, selectively, either of the positive stops.

The foregoing may constitute a description or definition of the first facet of the invention in its broadest or most general form. Even in this general form, however, it can be seen that this aspect of the invention significantly mitigates the difficulties left unresolved in the art.

In particular, by arranging the locating function to operate with respect to a positive stop rather than in a continuous range of adjustment, this aspect of the invention eliminates essentially all of the undesirable variabilities discussed above for earlier printers. On the other hand, by providing not one but exactly two such stops—and an endcap to forcibly set the locating element against one of these stops—this first aspect of the invention preserves a small degree of adjustability. As will be seen, that little reserved amount of adjustment makes not a little but an enormous difference in the manner and cost of dealing with production units that cannot perform adequately using just one stop.

Although this aspect of the invention in its broad form thus represents a significant advance in the art, it is preferably practiced in conjunction with certain other features or characteristics that further enhance enjoyment of overall benefits.

For example, it is preferred that the positive stops include a pair of hard surfaces respectively defined in the chassis, and that the endcap bias the rod against, selectively, one of the pair of hard surfaces. In this case it is also preferable that each end of the slide-rod have an associated pair of stops defined in the chassis, and an associated endcap.

We further prefer that each endcap grip one end of the slide-rod, pivot about a pivot point defined in the chassis, and have two stable positions. In this case preferably a biasing tab and a fastener aperture are defined in the chassis; and the endcap further includes a resilient lever arm for engaging the biasing tab and a fastener loop for cooperating with the fastener aperture to secure the endcap firmly in either of its two stable positions.

More generally it is preferred that the platen have locating bosses. These bosses are located substantially directly to the chassis.

In preferred embodiments of a second main facet or aspect, as with the first, the invention is inkjet printing apparatus for forming an image on a printing medium as an array of inkdrops. The apparatus includes a chassis.

In preferred embodiments of this second facet, the invention also includes some means for supporting such a printing medium from the chassis. For purposes of generality and breadth in describing our invention, we will refer to these means as the "first supporting means" or simply the "first means".

In addition the apparatus includes an inkjet printhead for ejecting such inkdrops, and some means for supporting the printhead from the same chassis as mentioned above. Again for breadth and generality we shall call these means the "second supporting means" or simply "second means".

The apparatus of the second aspect or facet of our invention also includes a mechanism for locating at least one of the first and second supporting means from the chassis. The mechanism includes, for each of the "at least one" supporting means, exactly two positive stops for use in locating the at least one supporting means relative to the chassis. In addition this apparatus also includes locking means for forcibly abutting the at least one supporting means against, selectively, either of the two positive stops.

To put the above description in different terms, the two-positive-stop locating mechanism may function to either locate the first supporting means from the chassis, or locate the second supporting means from the chassis—or both. Thus adjustment as between the two positive stops in the locating system (1) may be taken in the part of the system that controls or locates the first means, or (2) may be taken in the part that locates the second means, or (3) may be distributed, with respective parts of the adjustment being made to affect each of the two supporting means.

The foregoing may constitute a description or definition of the second facet of the invention in its broadest or most general form. Even in this general form, however, it can be seen that this aspect of the invention significantly mitigates the difficulties left unresolved in the art.

In particular, by arranging the locating function to operate with respect to a positive stop rather than in a continuous range of adjustment, this aspect of the invention eliminates essentially all of the undesirable variabilities discussed above for earlier printers. On the other hand, by providing not one but exactly two such stops—and locking means to forcibly set the locating element against one of these stops—this second aspect of the invention preserves a small degree of adjustability. As will be seen, that little reserved amount of adjustment makes not a little but an enormous difference in the manner and cost of dealing with production units that cannot perform adequately using just one stop.

Although this second aspect of the invention in its broad form thus represents a significant advance in the art, it is preferably practiced in conjunction with certain other features or characteristics that further enhance enjoyment of overall benefits.

For example, it is preferred that the second supporting means include a printhead carriage, and a carriage slide-rod; and that the at least one supporting means include the second supporting means and the carriage slide-rod.

In this case we also prefer that the pair of positive stops include a pair of hard surfaces respectively defined in the chassis, and that the locking means include a device that biases the rod against, selectively, one of the pair of hard surfaces. In this context we further prefer that the slide-rod have two ends, and that each end of the slide-rod have an associated pair of stops defined in the chassis, and associated locking means; here preferably the locking means respectively associated with the two ends of the slide-rod are mutually independent.

Also in the case of hard surfaces defined in the chassis, with biasing locking means, we prefer that an orifice, having a transverse dimension larger than the slide-rod diameter, be defined in the chassis; and that opposite edges of the orifice serve as the pair of hard surfaces. Most highly preferred is an orifice that is substantially circular, and of diameter larger than the slide-rod diameter by an overall clearance on the order of one quarter millimeter (one hundredth inch).

Still again in the case of hard surfaces defined in the chassis and biasing lock means, we prefer that a pivot point be defined in the chassis and that the locking-means device include an endcap that grips one end of the slide-rod, pivots about the chassis pivot point, and has two stable positions. Preferably this locking-means device further includes some means for securing the endcap firmly in either of its two stable positions.

As will be seen, for implementing our locking-means device we prefer to use an endcap which is highly elaborated to incorporate features for several different functions. It includes a pivot boss for achievement of desired motion between the two adjustment positions; it includes a resilient lever arm that is involved in both biasing and toggling the end of the rod; and it includes a fastener loop for use in securing the PPS adjustment once made. Furthermore the endcap is disposed to grip the very end of the slide-rod, and advantageously participates in locating the slide-rod longitudinally as well as vertically.

It will be understood, however, that the locking means recited herein are to be broadly construed and encompass a very great number of equivalents. For example, for purposes of our invention as most broadly conceived and implemented it is equivalent to distribute the above-mentioned several functions among two or more separate elements rather than to a unitary article such as a single endcap.

The locking means may engage or grip the slide-rod about less than the entire periphery of the rod. Furthermore the locking means need not operate pivotally or itself provide leverage, and need not incorporate a fastener loop but rather the adjustment may be secured in another way, although we find incorporation of these functions particularly advantageous.

Merely by way of example, a linearly operating cam arrangement would provide equivalent mechanical advantage. A separate or integral spring, acting either linearly or otherwise, would provide equivalent biasing. A strong clip with a camming or toggling action, or both, may serve to secure the adjustment. Moreover the locking means need not grip the very end of the rod but may instead hold it somewhat inboard from its tip, with separate provision for the longitudinal location of the rod.

Guided by such examples as to equivalents, a person skilled in this field will perceive a great many other articles, or combinations of articles, capable of equivalently performing the functions of our locking means. Our recitation of "locking means" is to be accordingly construed.

A like very great breadth of equivalents is to be understood for the first and second supporting means. Support and guidance of a printhead carriage may be provided by a noncylindrical rail—rather than a cylindrical rod—or by depending the carriage from, rather than resting the carriage upon, such a rod or rail. In principle the printhead may be guided and located directly, rather than through the intermediary of a carriage. The printing medium need not pass over a stationary platen, but may instead be clamped to a rotary platen—or even biased upward against the underside of a locating surface.

Where the "at least one supporting means" include the second means and slide-rod, we prefer that the first supporting means include a platen mounted to the chassis. We also prefer that the platen have locating features that are located substantially directly to the chassis.

In preferred embodiments of a third of its facets or aspects, the invention functions in an inkjet printer that forms an image on a printing medium as an array of inkdrops discharged from an inkjet printhead. The invention itself is an accurate system for establishing and adjustably controlling printhead-to-printing-medium spacing with no need for an assembly fixture.

This system includes a first support for such a printing medium, and a second support for such a printhead. In addition the system includes an adjustable mechanism for locating the second support with respect to the first support. This mechanism is distinct from the first and second supports.

In this system, the mechanism includes components that enable adjustment of the mechanism to control the spacing between the printhead and the printing medium. The adjustment-enabling components contribute zero uncertainty to said spacing.

The foregoing may constitute a description or definition of the third facet of the invention in its broadest or most general form. Even in this general form, however, it can be seen that this aspect of the invention too significantly mitigates the difficulties left unresolved in the art.

In particular, designers of prior systems have thought it necessary to make a choice between the desirability of being able to make an adjustment (to avoid scrapping or reworking production units that fail initial PPS tests) and the undesirability of introducing additional cost and an additional source of PPS error. By providing a PPS-control system which is adjustable—but in which the adjustment components themselves contribute nothing to error or tolerance in the final overall PPS— this aspect of the invention remarkably achieves in effect the best of two possible worlds.

Although this third aspect of the invention in its broad form thus represents a significant advance in the art, it is preferably practiced in conjunction with certain other features or characteristics that further enhance enjoyment of overall benefits.

For example, it is preferred that the first support include a platen, that the second support include a printhead carriage supported for sliding motion along a slide-rod, and that the mechanism locate the slide-rod with respect to the platen. In this case, another preference is that the system also include a chassis—and that the platen be located substantially directly from the chassis, and the mechanism locate the slide-rod substantially directly from the same chassis.

If these preferences are observed, then we find it also preferable that the mechanism include, formed in the chassis, a pair of opposed positive stops at opposite sides of the slide-rod, and a pivot point. The mechanism in this case should also include, mounted to the chassis for rotation about the pivot point, a retainer that has a fitting for gripping an end of the slide-rod to move the end of the slide-rod toward either of the positive stops. Another element of the same preferred mechanism is a toggling boss, also formed in the chassis, for restricting the retainer to two rotational positions wherein the retainer holds the slide-rod firmly against either of the positive stops. Finally the preferred mechanism includes a fastener for securing the retainer in one of the two rotational positions.

If the preferences just described are implemented, then it is still further preferable that the retainer also have an elongated resilient arm with an end, remote from the pivot point, for engaging the boss in said two rotational positions; and that in either of the rotational positions the resilient arm bend slightly, developing restoring force to bias the slide-rod against a corresponding one of the stops.

In preferred embodiments of a fourth basic aspect or facet, the invention is a method for manufacturing an inkjet printer that has a printhead, movably supported along a slide-rod, for directing inkdrops to a printing medium that is supported from a chassis. The slide-rod has two ends and the chassis has two oversize mounting holes for holding respective ends of the slide-rod. The method includes the step of positioning the slide-rod with its two ends in the oversize mounting holes respectively.

The method also includes the step of attaching to each end of the slide-rod a respective retainer that forces the slide-rod end in one of two opposite directions against the mounting-hole edge. The method additionally includes the step of orienting the retainer to force the slide-rod end in a particular one of the two opposite directions.

The foregoing may represent a description or definition of the fourth facet of our invention in its broadest or most general form. Even in this form it may be seen that the invention significantly advances the art. In particular by attaching and then orienting the retainer an assembler accomplishes without separate special installation tools (as typically required for many prior systems) a result that is superior in degree of accuracy and stability to the results of even more elaborate assembly methods heretofore.

Nevertheless we prefer to practice our invention with additional steps or constraints that even more fully optimize and enhance its benefits. For example we prefer to include the additional step of then securing the retainer to maintain the slide-rod end in the particular one direction. In this case we also prefer to include the steps of (1) then measuring the printhead-to-printing-medium spacing; and (2) then, if and only if the measured spacing is displaced in magnitude in a particular polarity and by an unacceptably large amount from a nominal spacing magnitude, reorienting the retainer to force the slide-rod end in the direction opposite to said particular one of the directions.

If these preferences are carried out, then we furthermore prefer to include the step of then securing the retainer to maintain the slide-rod end in said opposite direction. Here we have yet one added set of preferences, namely that (1) the printhead ejects inkdrops downward toward the printing medium; (2) orienting the retainer in the "particular direction" positions the slide-rod and printhead slightly below a nominal position, to establish a printhead-to-printing-medium spacing that is slightly less than the nominal spacing; (3) the particular polarity of displacement from nominal is toward even smaller values of spacing; and (4) if the measured spacing is unacceptably small, then the retainer-reorienting step includes forcing the slide-rod and printhead upward to increase the printhead-to-printing-medium spacing.

All of the foregoing operational principles and advantages of the present invention will be more fully appreciated upon consideration of the following detailed description, with reference to the appended drawings, of which:

BRIEF DESCRIPTION OF THE DRAWINGS

FIG. 9 is a like view of the printer chassis alone, but not enlarged (and not to scale);

FIG. 10 is an elevation of the right endcap shown from its outboard side;

FIG. 11 is a like view of the same endcap shown from its inboard side;

FIG. 12 is an isometric view, taken from left front and below, of the same endcap;

FIG. 13 is a complementary isometric view, taken from left rear, of the same endcap;

FIG. 14 is a view like FIG. 9 but incorporating the right endcap of FIGS. 10 through 13;

Figure 20:
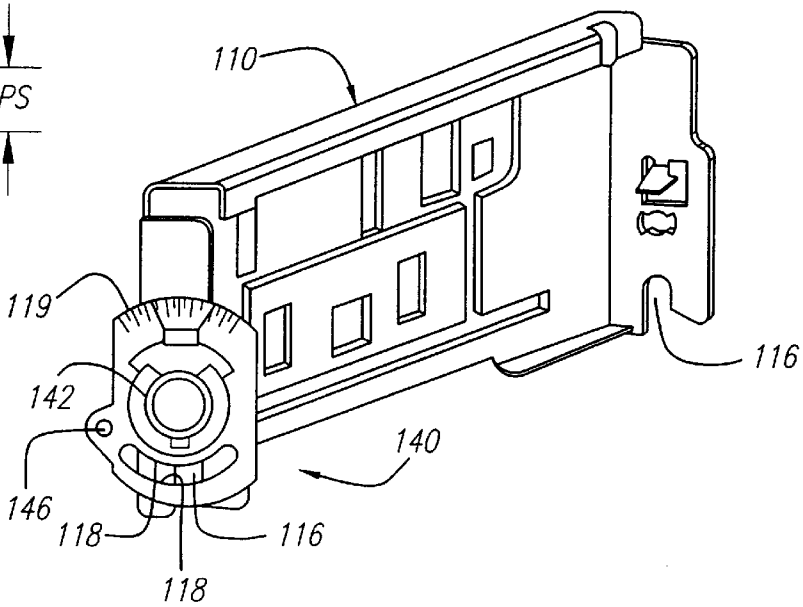
FIG. 20 PRIOR ART
FIG. 20 is an isometric view of the PPS adjustment and control system in an earlier inkjet printer of the Hewlett Packard Company.

DETAILED DESCRIPTION OF THE PREFERRED EMBODIMENTS (a) General layout—Although novel, our invention operates within the conventional conceptual framework of FIG. 1, with the provisos that the chassis elements 10, 10' respectively locating the carriage slide-rod and platen are neighboring portions of a common chassis 10 (FIG. 2) and the platen is not a rotary type but rather a flat-rib structure to be described below. In preferred embodiments the carriage 20 has two main support bushings 21, an auxiliary support wheel 22 suspended from a top outrigger 23, and a forward mounting region 24 for attachment of the pens (not shown in FIG. 2).

Initially the ends 6" of the rod fit loosely, with clearance of about 0.25 mm (0.01 inch), in respective left and right apertures 16', 16 formed in two outboard panels 11 of the chassis. These chassis panels 11 project forward from a laterally extended main chassis panel 13.

This main panel 13 stands at an angle of approximately fifteen degrees to the true vertical (assuming that the printer is placed on a horizontal surface), and in effect the orientation of this panel defines for purposes of this document what is meant by "vertical". In other words, operations of the PPS-control system described herein as "vertical" are actually parallel to this angled panel 13.

Among other chassis features of particular interest to the present invention is a pair of small laterally-outward-projecting biasing tabs 19', 19. Each of these precisely positioned tabs is used, as will be seen, to toggle its corresponding end 6" of the rod between two accurately located positions within the apertures 16', 16—and also to calibrate an amount of torque that is applied to constrain that rod end in either of those positions.

(b) Slide-rod mounting—Once in position, each rod end 6" is held firmly against a carefully controlled segment of the respective aperture edge 16', 16 by a respective unique slide-rod-biasing retainer or "endcap" 40', 40 which will be described in detail shortly. Although very well optimized, the endcaps perform a function which is remarkably and elegantly simple.

Without contributing at all to uncertainty or tolerance in slide-rod position, the endcaps implement an extremely accurate locating function. Each endcap is secured to its associated chassis endwall 11 by a respective fastener 49', 49, thus capturing and positionally stabilizing the slide-rod 6 in the chassis 10.

Figure 1:
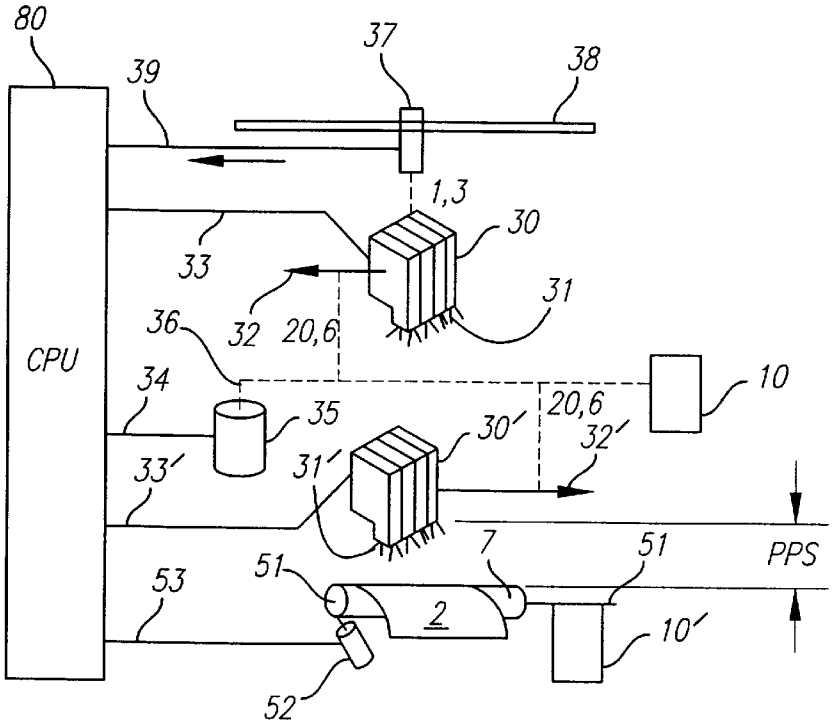
FIG. 1 PRIOR ART
FIG. 1 is a highly conceptual block-diagrammatic representation of a generalized hardware system according to the invention, also applicable to most prior-art systems.
Figure 2:
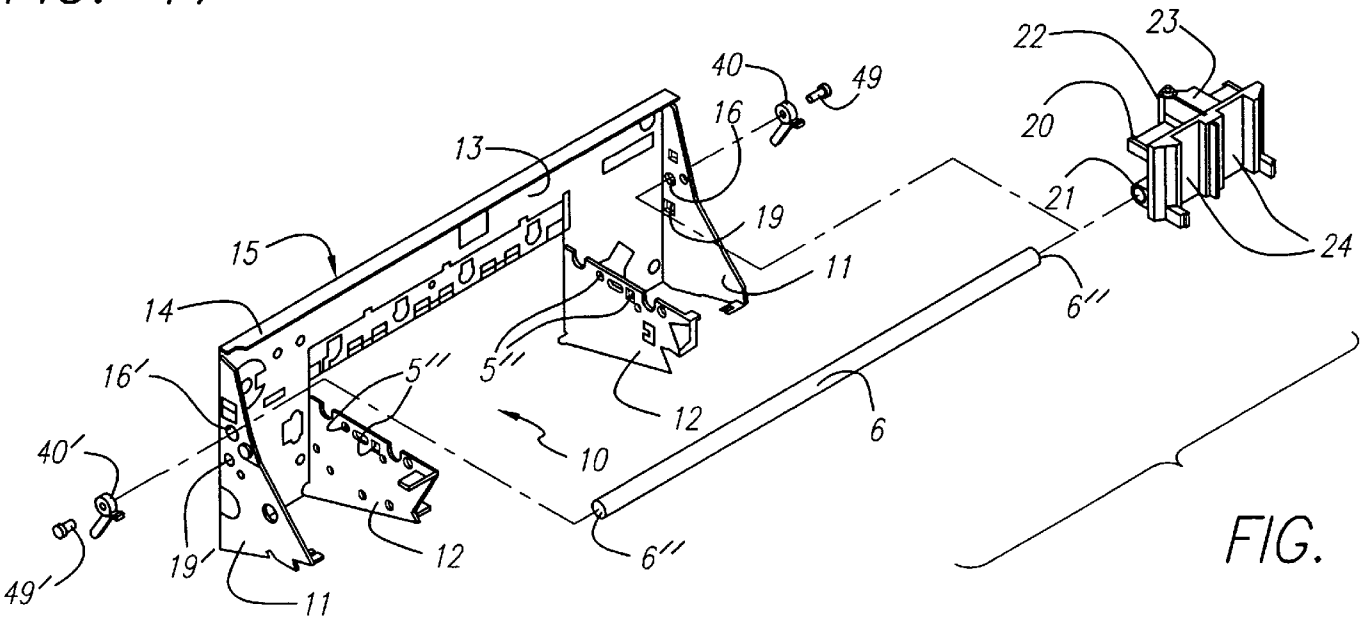
FIG. 2 is an exploded isometric view of the PPS-control system taken from upper front left and showing the chassis, printhead carriage, carriage-supporting slide-rod, slide-rod-biasing retainers or "endcaps", and securing screws before assembly.

(c) Platen mounting—Another set of forward-projecting chassis walls 12, intermediate or inboard between the endwalls 11, contain precision cutouts 5" for holding and precisely positioning the platen locating elements 51 (FIG. 1). Thus the chassis 10 of FIG. 2 is a high-precision integrated structure that locates both the slide-rod 6 and platen 7 in common.

The chassis thereby accurately locates the carriage 20 and printheads 30 with respect to the printing medium 2. This relationship is the paper-to-pen spacing PPS.

Figures 3, 4, 5, 18:
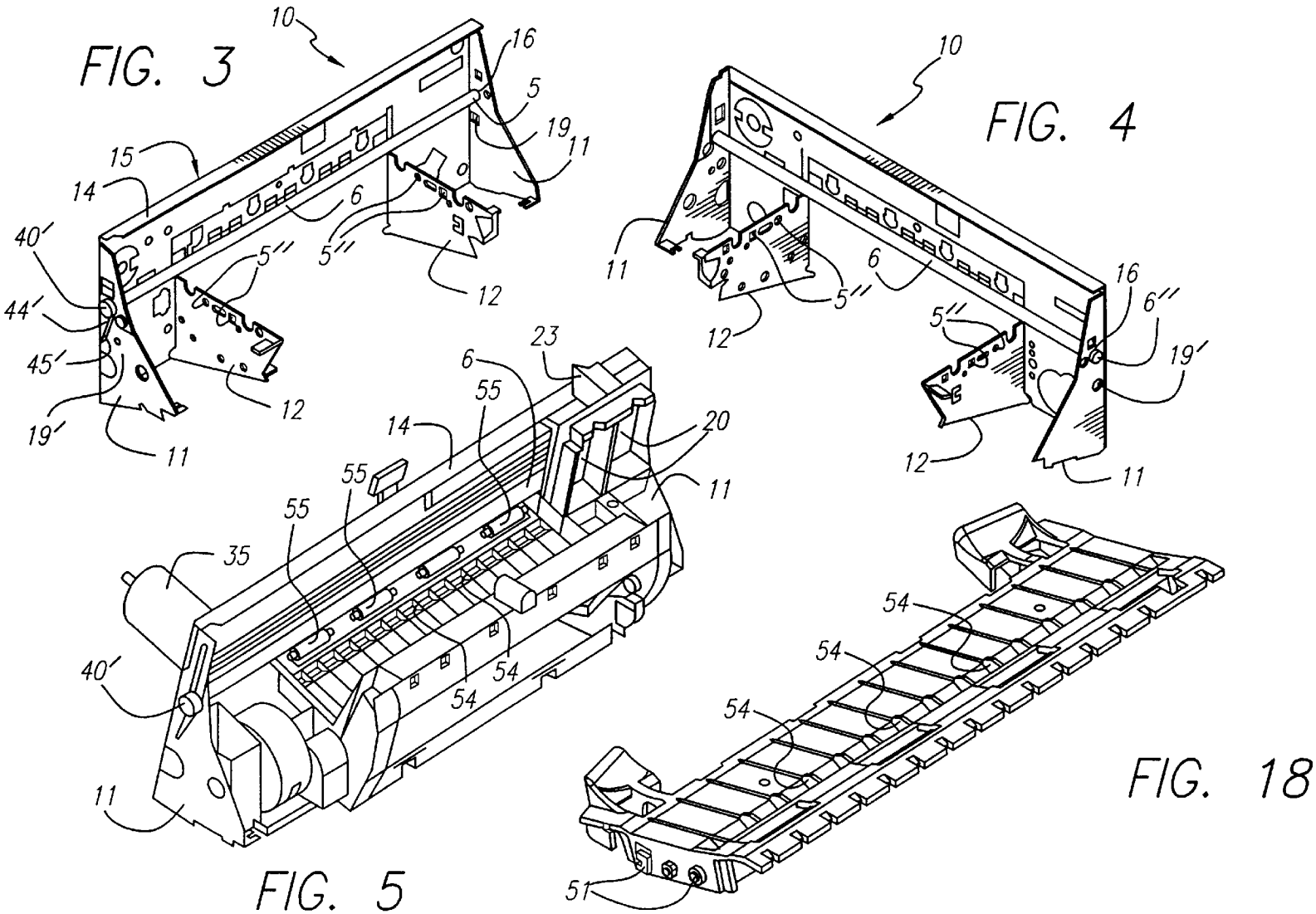
FIG. 3 is a like view from a roughly similar vantage but showing the same parts assembled.
FIG. 4 is a like view taken from above right, and with the right endcap omitted.
FIG. 5 is a view like FIG. 3 but now including numerous other components as finally put together to form the complete print-mechanism assembly.
FIG. 18 is an isometric view of the platen, taken from upper right rear.

In our preferred embodiment the platen is not a classical rotating cylinder with a shaft as suggested in FIG. 1, but rather is a molded, generally flat structure with a series of shallow upstanding ribs 54 (FIG. 18). The upper edges of the ribs locate the print medium very precisely. While this ribbed-tray platen assumes the printing-medium support function of the previously discussed traditional cylindrical platen, the printing-medium driving function is performed by separate drive wheels 55 (FIG. 5).

In our preferred embodiment no adjustment is provided for the platen. Its locating elements, which include a set (at each respective end of the platen) of two small molded bosses 51, are simply locked in their corresponding endwall cutouts 5". The circular boss locates the platen as to height, and the notched square boss generally stabilizes the unit against rotation. (The intermediate, smaller square boss visible in the drawing is for a different purpose.)

(d) Slide-rod precision positioning—The left endcap 40' (FIG. 3) secures the slide-rod at the chassis left endwall. While the endcap grips the left end of the rod, a resilient spring arm 44' of the endcap is bent very slightly to allow positioning of the endcap tip 45' behind the biasing tab.

This slight bending of the arm 44' develops a restoring force which, as will be seen, is redirected to force the slide-rod downward solidly against the bottom of its aperture. The right end of the rod receives like treatment, but for purposes of clarity is shown (FIG. 4) without its endcap.

Although the chassis is drawn with only the rod and left endcap, for simplicity of illustration, in practice of course the rod must first be threaded through the pen-carriage bushings before installation to the chassis. This relationship is more realistically shown, together with attachment of a starwheel assembly and a great many other components, in FIG. 5—and the relationship of this assembly to other parts of the printer is more fully illustrated and discussed in the previously mentioned patent document of Hong et al.

(e) Performance with a single positive stop—A typical distance $PPS_{typ.}$ (FIG. 6) between the printhead writing surface 1 and print medium 2 is established by the combined dimensions of the printhead 30, carriage 20, slide-rod 6, chassis 10 and platen 7. (As illustrated, and for reasons to be explained shortly, we prefer to set this representative PPS value below the value $PPS_{central}$ which is at the center of the acceptable range.)

Although the writing surface (nozzle plate) of the pen is actually different from the surface of the pen that supports and locates the pen, for conceptual purposes the writing surface 1 is here illustrated as congruent with the supporting surface of the pen. This supporting surface rests upon a locating surface 3 of the carriage 10.

Figure 6:
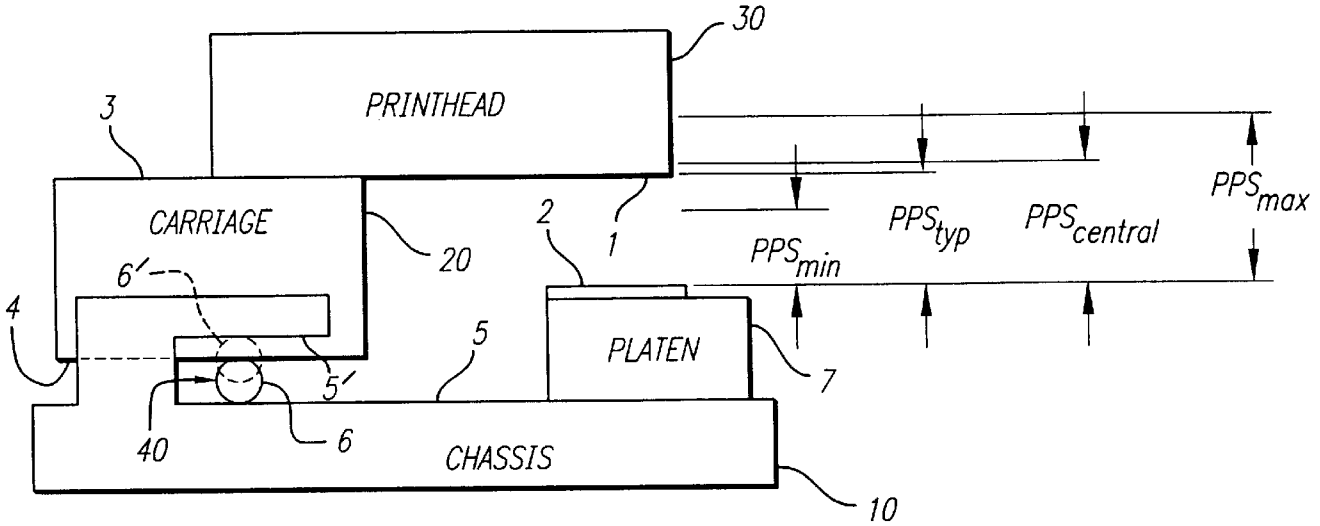
FIGS. 6 and 6A are conceptual diagrams of the selective-positive-stop operating principles of our invention.
Figure 6A:
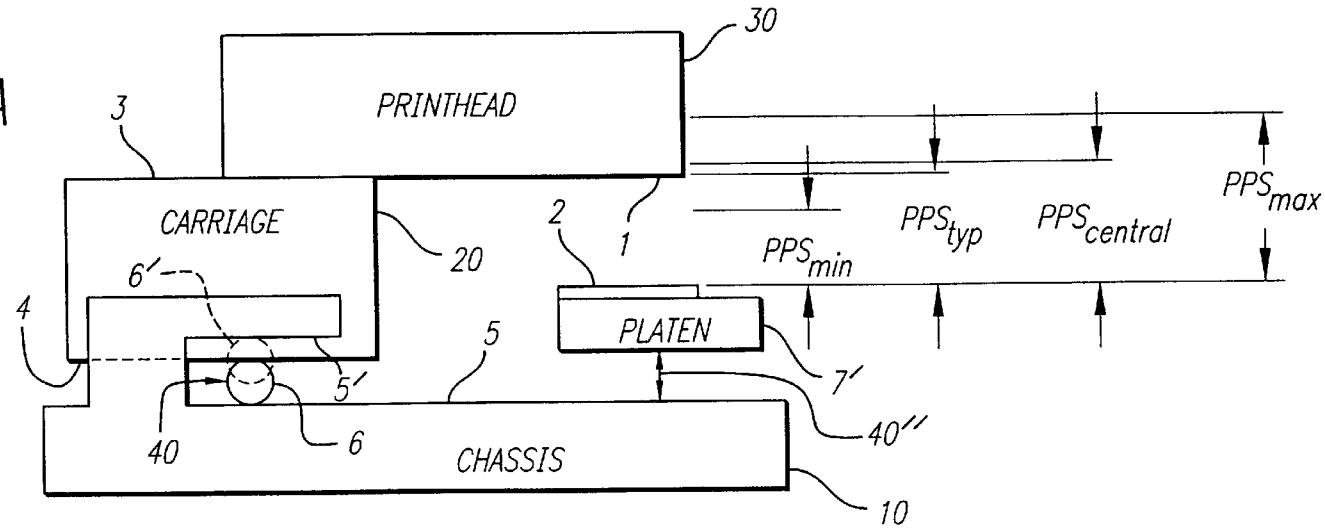

The carriage in turn has a supporting and locating surface 4 (actually surfaces of bushings that are insert-molded into the carriage) that effectively rests upon the slide-rod 6 as illustrated in the solid line in FIG. 6. The slide-rod is supported and located at a first positive supporting surface or stop 5.

Again for conceptual purposes, this same positive stop 5 is indicated as congruent with the supporting and locating surface of the platen 7. In actuality, as shown earlier, in our preferred embodiment the chassis elements 16, 5" that locate the slide-rod and platen are neighboring cutouts in the chassis walls 11, 12. Alternatively, the platen can be located with respect to the chassis 10, as shown in FIG. 76A, by a mechanism 40".

In practice we have found that the representative PPS value thus established is actually within the acceptable range in nearly all production printers—or more specifically, approximately ninety-six percent of the manufactured units. Thus a 96% rate of successful operation for these machines could be established with no adjustment whatever, merely by locking the mechanism (as symbolized by the arrow 40) downward into the condition illustrated—particularly with the slide-rod in the position 6 shown in solid lines in FIG. 6.

(f) Opposed positive stops—This result, however, also corresponds to a rejection rate of four percent. This rate would not necessarily be associated with any single component (although one might be tempted to point to the relatively complex chassis 10 as a culprit) since as mentioned earlier it arises from accumulated dimensions and tolerances of several elements.

Thus the four-percent failure rate would be relatively costly to correct on a rejection basis. The cost would be extremely disproportionate to the fraction of rejects since it would probably entail disassembly and relatively complex, time-consuming efforts to determine which of the parts—if any!—was actually out of tolerance on an individual basis. Using each of the same group of parts in combination with other parts might produce a usable unit, or might not.

Our invention proceeds to recapture essentially all of those remaining units while avoiding all disassembly, parts replacement, and elaborate component-matching efforts—and without compromising precision or stability of the resulting PPS value. We accomplish this by providing (1) a second positive stop for the slide-rod, and (2) a mechanism that can forcibly lock the rod in either position while contributing nothing at all to inaccuracy or imprecision in the overall PPS.

Even with respect to a single positive stop, preferred embodiments of our invention are the first desktop units to avoid the previously described problems of continuous adjustment. These printers may also be the first desktop machines to incorporate referencing of both slide-rod and platen to a common chassis unit. Use of opposite dual stops represents an even greater advance in the art.

Whereas the first stop 5 is symbolized (FIG. 6) as an upward-facing surface of the chassis 10, the second stop 5' is shown conceptually as the underside of an elevated open arm or bar of the chassis 10—i.e., by an element that is integral at just one end with the chassis. In this case the previously mentioned lock mechanism forces the slide-rod 6' to an upward position (shown in the broken line), to engage that second stop 5'.

Within the acceptable range of PPS values, print-quality performance is neither equal nor symmetrically varying, but rather peaks near the bottom of the range, essentially at the minimum value $PPS_{min.}$ of the range—i.e., the range from minimum $PPS_{min.}$ to maximum $PPS_{max.}$. We therefore believe that an ideal implementation of this strategy would be to set all the tolerances so that the target or most likely PPS value, within the overall production process, would be just at the bottom $PPS_{min.}$ of the acceptable range.

For a variety of reasons, however, tolerances of the several parts involved do not necessarily vary about their nominal values, in a statistical sense. For instance fabricators in general are free to systematically cluster manufactured dimensions about either higher or lower values within that range—as may suit the economics or mechanical aspects of their own processing.

Accordingly, although we targeted the minimum value $PPS_{min.}$, the average value on our production line has been about halfway from that value to the value $PPS_{central}$ at the center of the acceptable range—or, in other words, about a quarter of the way up the range from the bottom. This average value, which also may be taken as a representative PPS value $PPS_{typ.}$, though not precisely at the bottom of the range as most highly desired, is well within the acceptable PPS variation of ±0.37 mm (±0.015 inch) about the central value $PPS_{central}$.

For our preferred embodiment, roughly, the ideal value at the bottom of the range is roughly $PPS_{min.}$=1.09 mm (0.043 inch), the central or median value $PPS_{central}$=1.47 mm (0.058 inch), and the highest permissible value $PPS_{max.}$= 1.85 mm (0.073 inch). The previously mentioned average value in production, again roughly, is $PPS_{typ.}$=1.30 mm (0.051 inch). This value is roughly 0.17 mm (0.007 inch) below the central value.

Because we preset the typical or nominal PPS value $PPS_{typ.}$ below the central value $PPS_{central}$ by an amount that is a significant fraction of the overall usable range of PPS, essentially all units of the four-percent failure rate have measured PPS that is too low. Essentially none has a PPS that is too high.

In almost all failed units, therefore, setting the slide-rod to its upward position 6' therefore shifts the PPS value toward or into its useful range. In other words, raising the slide-rod 6, carriage 20 and pen 30 increases the PPS from its too-small value.

The overall clearance between the two stops 5, 5' minus the diameter of the slide-rod 6 defines the amount of this upward shift. We dimension the chassis so that this shift is approximately 0.25 mm (0.01 inch), or roughly one-third of the overall usable PPS range—which in essentially every case shifts the PPS into that range.

From the foregoing discussion it will be apparent to a person skilled in this field that a better failure rate, i.e. less than four percent, might be achieved by setting the nominal value to the central PPS. Such a strategy, however, would not produce a negligible failure rate.

We developed these considerations through a software-aided comprehensive analysis of tolerances in the loop of dimensions (FIG. 6) affecting PPS. Such a "VSA analysis" is advantageously used to find the needed adjustment as a central value, range or function.

Figure 7:
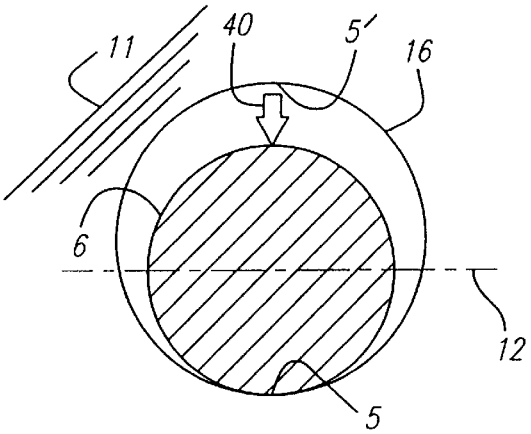
FIG. 7 is a right side elevation, partly in cross-section and highly enlarged, of the printer chassis and slide-rod—with the rod in a particular operating position—showing the same principles in a more mechanical presentation but with exaggerated difference between the diameters of the rod and mounting hole.

(g) Optimization of positive stops—The open stop structure discussed in the preceding section is within the scope of our invention, although we prefer a more stable structure as will now be seen. In preferred embodiments of our invention the positive-stop structure is implemented as a circular aperture 16 (FIG. 7) formed in the chassis endwall 11.

The diameter of this aperture 16 is punched approximately 0.25 mm larger than the diameter of the slide-rod 6. The aperture diameter is extremely stable, since an aperture is intrinsically supported along both edges.

To adjust the system for 96% of production units, the locking mechanism is set to bias 40 the slide-rod 6 downward toward the bottom 5 of the circular aperture. To adjust the system for the 4% of units that would perform poorly at that setting, the locking mechanism is instead set to bias 40'

Figure 8:
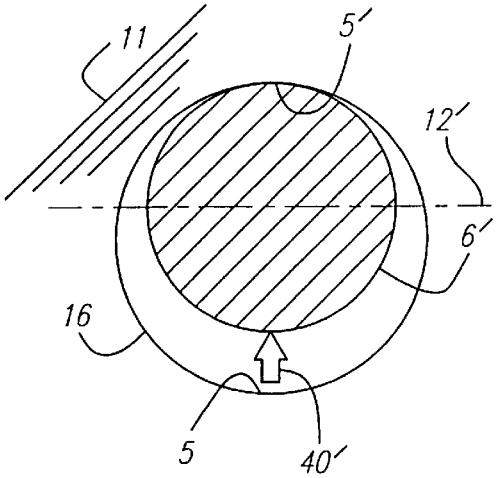
FIG. 8 is a like view with the rod in an alternative operating position.

(FIG. 8) the slide-rod upward toward its position 6' that engages the top 5' of the same aperture.

Although our locking mechanisms exert adequate force to positively engage the slide-rod with the top of the aperture, overcoming shock and vibration even when the rod is in its upward position 6', nevertheless in principle some slight additional stability may be obtained in the lower position 6 through the action of gravity. This may perhaps come into play in instances of exceptionally rough treatment of a printer after it has left the factory, for example if the printer is dropped or strongly struck while out of its protective shipping container, in the field.

Strong vibration, too, although somewhat more symmetrical in its effects, may be able to influence the slide-rod in its upper position more significantly than in the lower. In addition to more robust support in purely mechanical terms, the lower position may also provide more reliable electrical grounding. Based on all this reasoning we have elected to configure the structure so that it is the lower position 6—i.e., with the rod supported by the chassis—which is used in 96% of production units, rather than the upper.

Our invention is amenable to use of a circularly asymmetrical aperture (e.g. a square or rectangle, an oval, or an arbitrary shape), and such a geometry could offer certain advantages. We have elected, however, to employ an aperture in the form of a circle because any other shape would have to be oriented—thereby incurring the associated tolerances for the orientation.

We believe that it is important to provide a stop surface that is not inclined, as such a surface could leave the slide-rod subject to angled vertical movement, edging forward or rearward along the stop surface. Thus even a nominally (but imperfectly) horizontal straightedge stop is in principle inferior to a circular aperture.

The latter, to an excellent approximation, is dependent upon only correct vertical positioning of its center, together with a reasonable degree of circularity. (Gross horizontal mispositioning can cause some problems, but the system is far less sensitive to shifts of the entire pen array parallel to the paper than to PPS shifts.)

(h) Optimization of the locking retainer—The mechanism we have developed for locking the slide-rod 6 in place without contributing to imprecision is a small plastic "endcap" part mentioned earlier. In addition to the slide-rod, the endcap engages a pivot-point hole 17 (FIG. 9) in the adjacent chassis endwall 11, and also engages the associated biasing tab 19.

The endcap (shown in FIG. 10 in matching orientation with the endwall of FIG. 9, but enlarged relative to the endwall) has two slightly flexible arms 43 that allow the structure just enough deformation to facilitate its rotation about the pivot-point hole without compromising a firm grip on the slide-rod. The cap also has a resilient arm 44 that serves as a kind of built-in torque wrench—i.e., it doubles as both a torque-applying lever and a spring.

The endcap also has a small outboard-projecting handle 45 by which it is readily pulled away from the chassis endwall 11 to bypass the biasing tab 19. In addition the endcap has a hole 46 to accommodate a fastener 49 (FIG. 2) that passes into a corresponding hole 18 in the endwall.

In use, the part of the endcap which fits in the endwall pivot-point hole 17 is a cylindrical pivot boss 42 (best seen in FIG. 13). The fit at this point is tight but rotatable.

A cylindrical cavity 41 (FIGS. 11–13) in the endcap makes a relatively tight so-called "transition fit" (i.e., a possibly but not necessarily an interference fit) with the associated end 6" of the slide-rod. Rotation of the handle 45 therefore rotates the rod end 6" about the pivot-point 17.

The line of centers of the pivot and the cavity (and slide-rod) is substantially horizontal. Slight rotation of the rod end 6" about the pivot-point 17 accordingly is substantially vertical (as defined above for purposes of this document)—the desired adjustment direction for PPS, in the mechanism shown.

Considering the extremely short distance of its travel, the PPS adjustment is in essence a pure linear adjustment of the rod, up and down, rather than a rotational motion. We have chosen this mode of adjustment to avoid the undesirable nozzle-plate rotation (relative to the print medium) which is associated with the rotary adjustment scheme of the Canon printer discussed earlier.

The lever-arm length from the pivot point 17 to the portion of the arm 43 that engages the biasing tab 19 is, as can be seen, just slightly more than twice the effective lever-arm length from the same pivot point to the center of the cavity. Thus movement of the handle 45 would displace the tab-engaging point of the lever about twice as far as the slide-rod—but for deformation of the lever itself.

Taking account of lever deformation and the resulting restoring force, the endcap instead converts a large fraction of the lost motion at the handle 45 into torque for forcing 40 (FIGS. 7 and 8) the rod against the top or bottom edge of the endwall aperture 16. This spring action or bias persists when the handle is held in such a deformed position to either left or right.

That, as noted earlier, is the function of the toggling and biasing tab 19. The handle 45 is simply tucked into position to one or the other side of the biasing tab, to both select the PPS range and bias the PPS adjustment into the selected range.

A fastener driven through the endcap fastener hole 46, and into the corresponding endwall fastener hole 18, stabilizes or locks the mechanism at the selected setting and bias level. Driving the fastener cannot significantly affect the position of the handle 45 or resilient arm 44 with respect to the biasing tab 19, and has negligible influence on the setting.

As long as the biasing force exerted by the arm exceeds a firm positive level relative to sundry forces within the mechanism acting to displace the slide-rod, the exact bias level is not significant. Forces to be taken into consideration are those reasonably expected in rough handling of the printer in the field, as these are generally much larger than any forces that arise in operation of the system.

Forces arising through rough handling are readily estimated through drop tests of the apparatus in its shipping container—at various angles etc. Accordingly the endcap is readily designed to make no contribution to uncertainties or tolerances in the system PPS, which are determined solely by tolerances at the hard stops 5, 5' and elsewhere in the mechanical system.

Figure 15:
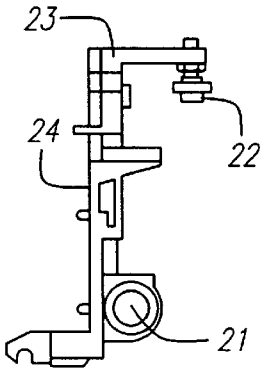
FIG. 15 is a right side elevation of the printhead carriage.

(i) Carriage refinements—For minimum stress and thus finest positional accuracy, the carriage main bushings 21 (FIG. 15) are insert-molded rather than pressed into place in the carriage body 20. In other words, each main bush is positioned in a mold that will be used to form the carriage body, and the body is then molded in place around the bushings.

In the inkjet printer art, this is an important innovation that significantly contributes to PPS control. It eliminates all of the contributions to bushing misalignment that are induced by stress during the press-fitting used heretofore, and more generally produces bushings of higher accuracy in dimensions, shape and position.

Figure 16:
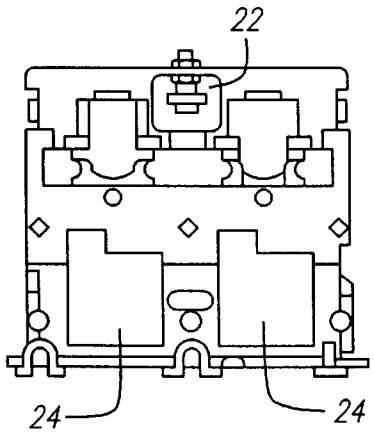
FIG. 16 is a front elevation of the carriage.
Figure 17:
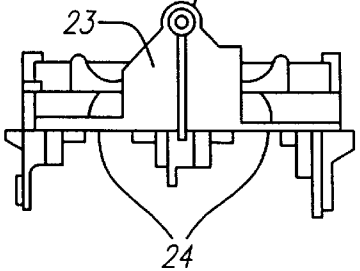
FIG. 17 is a top plan of the carriage.

The bushings 21 ride along the slide-rod 6. An axle pin for the auxiliary support 22 (FIGS. 15–17), too, is molded into the carriage. That auxiliary feature is a small wheel, known as a carriage roller, which rolls along the upper rear surface 15 (FIGS. 2 and 3) of the transverse panel 13.

Although the main bushings 21 establish the position of their own centerlines as substantially coaxial with the slide-rod, the carriage 20 would be free to rotate about that rod if it were not thus restrained in one rotational degree of freedom by the auxiliary support 22. The PPS accordingly depends very heavily upon tolerances in both the bushings and axle pin.

Because the auxiliary support can roll equally well slightly higher or lower along the rear surface 15 of the transverse panel 13, it simply follows the height adjustment of the slide-rod 6. We therefore do not find it necessary to provide any adjustability for the secondary support 22.

(j) Assembly-line procedures—Our invention encompasses a very streamlined and easy assembly procedure, for PPS control, that entails no special tools or fixtures other than a PPS measurement device, no follow-up verification station, and virtually no rejects. Installation and adjustment call for only a common screwdriver or, as preferred in current-day assembly procedures, a commonplace pneumatic or electric tool known as a "screw gun".

First the slide-rod 6 is installed 91 (FIG. 19) in the endwall apertures 16. In the process, the rod is threaded through the carriage main bushings 21, and the carriage top outrigger 23 is extended over the top rail 14 of the chassis transverse panel 13, so that the rolling support 22 is in position to contact the rear face 15 of that panel.

Next the biasing retainers or endcaps 40 are fitted 92 to the slide-rod ends 6", and fully seated to take up all longitudinal play of the rod in the chassis. In most cases the endcap 40 has a diametral interference fit to the rod, although there is a small possibility of a very slight 0.05 mm (0.002 inch) clearance. The pivots 42 are inserted into their respective pivot-point holes 17 in the endwalls 11.

Both retainers 40 are initially oriented 93 for the representative pen-to-paper spacing $PPS_{typ.}$ which in our preferred embodiment suits 96% of production units. In FIG. 14 this position is shown in the solid line 44, 45.

In this orientation the narrow, remote portion of the lever 44, just above the handle 45, presses against the forward (leftward in the drawing) side of the biasing tab 19 as shown. To set the lever in that position the assembler preferably grasps the outward extending handle 45 and gently pulls the end of the lever outward away from the endwall surface so that the lever just clears the biasing tab—and with the lever in that position moves the handle forward (leftward as drawn) until the lever tip can drop back solidly against the endwall surface and just against the front edge of the biasing tab.

The fastener 49 is then installed to secure 94 the retainer in this position. The left and right biasing retainers (endcaps) are mirror images of each other, each with its own fastener. At this point the pen-to-paper spacing has been tentatively set and locked in its default position automatically in the course of assembly.

Next the PPS is measured 95, using a custom but conventional measuring device which is mounted in a body that matches a printhead body. The measuring device registers against the same datum surfaces of the carriage, and has a pen-nozzle-plate emulating surface that assumes the same position as a real pen nozzle plate will occupy during printer operation.

This device measures the distance from itself to the platen. (Paper and other printing media are assumed to conform evenly to the platen ribs 54 and are not included in the measurement.) The actual PPS is thus equal to measured distance minus the known effective thickness of the assumed printing medium.

The measuring device reads out either actual PPS or an indication of whether the PPS is too low (or too high). The assembler notes this information to determine 95 whether the reading is within specification.

If so ("y" in FIG. 19), i.e. if the PPS reading or PPS-category indication is within the acceptable operating range—either slightly below the central value $PPS_{central}$ as diagramed in FIG. 1, or within an acceptable distance above that value—then this procedure is complete 97. The unit in progress proceeds to the next manufacturing procedure.

If instead the PPS reading or PPS-category indication is too low ("n"), the slide-rod should be reset against the upper stop to raise the carriage. For this purpose the assembler first loosens 98 both securing screws 49.

Next the worker grips the retainer handles 45 to move them out for clearance of the biasing tabs 19, and reverses 99 the retainers—i.e., shifts both handles back (rightward in FIG. 14) so that the lever arms can fit against the rear edges of the biasing tabs. For example, the endcap lever at the right endwall is thus placed in the position 44" shown in the broken line. The handles are then again released against the endwall surfaces, and the fasteners resecured 94' to complete 97 the procedure.

Figure 19:
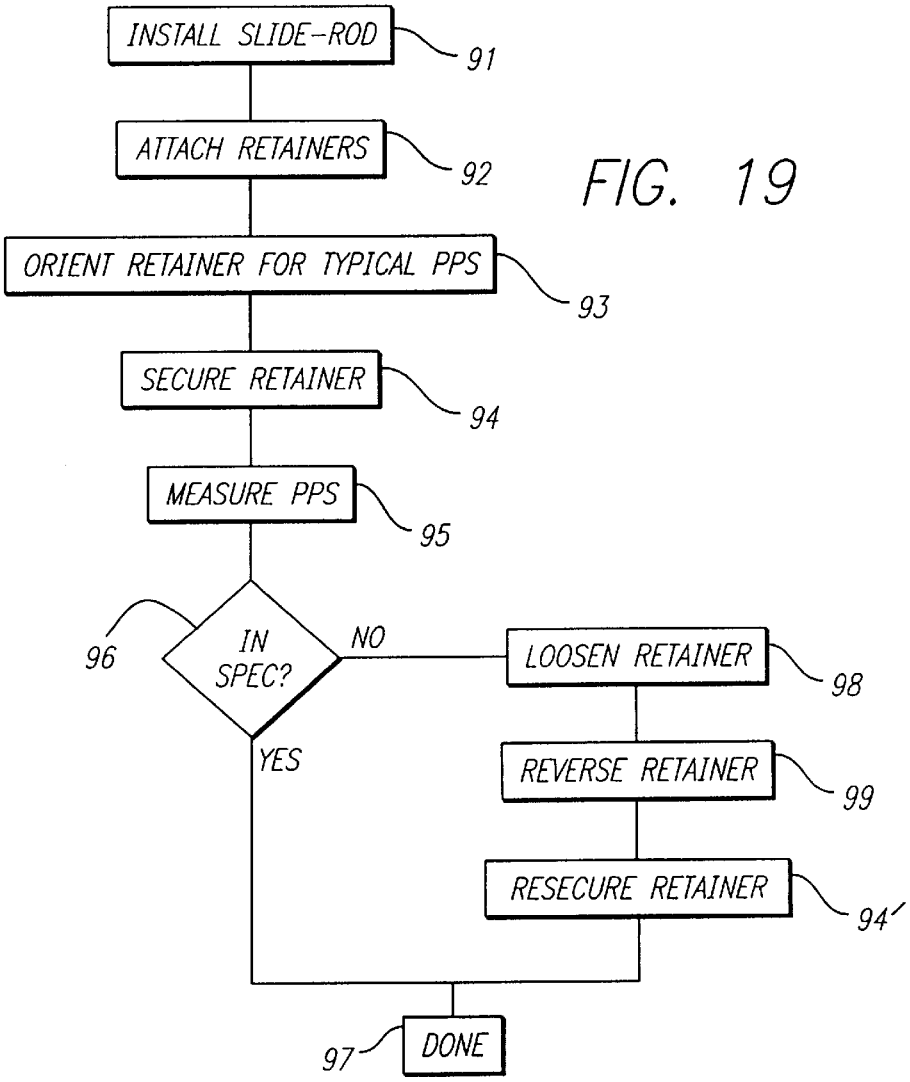
FIG. 19 is a procedural flow chart showing the entire PPS-control method of our invention.

In principle at point "n" in FIG. 19 there exists a possibility that the initial PPS measurement is either too far below the central value, or too far above it, so that neither position of the biasing retainers can produce PPS within specification. This possibility can actually occur only if some component fails to be within specifications—which is normally foreclosed by quality-control inspection before beginning assembly—or the apparatus is assembled incorrectly. We nevertheless prefer to have the assembly worker check for these conditions too, and of course this requires that the measuring instrument be capable of registering them.

(k) Philosophy—PPS adjustment may typically be done either to merely keep systems in specification or to "dial in" the very best possible PPS. Reviewing the previously discussed Canon and Epson products does not readily reveal which underlying approach was used. As to the prior HP printer, all units are adjusted in an attempt to optimize the PPS.

As the foregoing disclosure makes clear, our present philosophy is rather to place the PPS within its optimum operating range. This philosophy relies upon an important empirical fact—namely, that the quality of printed images is relatively insensitive to variations of PPS, within its optimum range of just less than ±0.4 mm.

Performance of the more than one million printers manufactured according to our invention has confirmed the validity of this philosophy. Interestingly, although it might seem that the earlier Deskjet configurations—by virtue of their greater adjustment capability—should be capable of producing more units with nominal PPS measurements, this is not so; instead our invention has proven to produce a smaller PPS variation than the adjustment capability of the Deskjet machines.

Yet, even with the simple adjustment scheme described above, optimization is still an option. For example, we assume a printer mechanism which must have PPS between $PPS_{min.}$=1.4 and $PPS_{max.}$=2.1 mm to be acceptable, the central value $PPS_{central}$ being 1.75, and we assume that our system can change PPS by 0.25 mm. A mechanism with PPS of 1.15 would be adjusted up to 1.4 mm and thereby become usable. A unit coming in at 1.4 mm (0.35 mm below central), however, could be adjusted up to 1.65 mm—possibly making it even better (0.1 mm below central), if the improved print quality justified it.

The precise strategy, however, should be tailored to the fact that print quality, as mentioned earlier, is slightly better for some PPS values below the center $PPS_{central}$ of the acceptable range. In other words, although print quality is insensitive to PPS within the acceptable range there is an optimum PPS value which tends to be between $PPS_{min.}$ and $PPS_{central}$.

Additionally, there is the option to adjust only one end of the rod and not the other. For sake of simplicity in our preferred embodiment we simply adjust both ends or neither, to bring the system into specification. The option exists, however, for greater control of PPS if necessary or desirable.

Moreover in purest principle as suggested earlier it is also possible to position the platen, as well as the carriage slide-rod, as between two positive stops. This strategy would lead to a total of four possible PPS combinations, even using common adjustments at the two ends of each element as in our now-preferred embodiments, or sixteen possible combinations without that restriction.

(l) Comparison with products discussed earlier—Unlike the Canon and earlier HP printers mentioned above, preferred embodiments of our invention are insensitive to driving of the fastener that locks the adjustment. In our system, tightening down that screw cannot overcome the spring load established by the endcap arm 44 and does not significantly affect PPS.

In comparison with the Epson and HP units, our preferred embodiments have a far smaller number of parts (including chassis parts) and fasteners. As a result, those embodiments of our invention avoid the substantial distortions that seem inherent in such compound structures, as well as the resulting high rate of intervention for PPS adjustment.

The overall parts count for our most highly preferred system is seven—in comparison with nine for the Canon, twenty for the Epson, and eleven for the Hewlett Packard printer. These raw numbers say a great deal about not only the cost of parts and cost of time to assemble them but also the probable level of associated failure and rework time.

Relative to other Hewlett Packard assembly operations, our invention has eliminated a complex process, making the assembly process more robust, and more flexible. As a result we experience fewer problems in the operation of our manufacturing line and we can more easily develop multiple lines worldwide. The invention has also shortened the time needed to set PPS on the manufacturing line, and eliminated the need for a verification station.

(m) Representative dimensions—We prefer to practice our invention using the dimensions and tolerances stated (in millimeters) below.

| | | |
|---|---|---|
| 9.0 | +0/−0.013 | slide-rod diameter |
| 9.038 | ±0.013 | carriage-bush inside diameter |

-continued

| | | |
|---|---|---|
| 9.0 | ±0.05 | endcap recess 41 inside diameter (no draft) |
| 12.04 | ±0.1 | center-to-center, pivot 42 to endcap recess 41 |
| 32 | | endcap lever-arm 44 approximate length (from center of recess 41 to tip of handle 45) |
| 28 | | endcap lever-arm 44 approximate effective length (from center of recess 41 to point of engagement with biasing tab 19) |
| 4.4 | | endcap lever-arm approximate width near root (adjacent to fastener hole) |
| 2.00 | ±0.1 | endcap handle 45 width |
| 1.3 | | biasing tab 19 approximate width |

The endcaps 40 are made of polycarbonate. To make it easier for assembly personnel to distinguish them, we have the two caps for the opposite ends of each assembly molded of respectively different-color material—preferably one cap clear and the other black.

The above disclosure is intended as merely exemplary, and not to limit the scope of the invention—which is to be determined by reference to the appended claims.

What is claimed is:

1. Inkjet printing apparatus for forming an image on a printing medium as an array of inkdrops; said apparatus comprising:

a chassis;

a platen for supporting such printing medium from the chassis;

an inkjet printhead for ejecting such inkdrops;

a printhead carriage, and a carriage slide-rod, for supporting the printhead from the same chassis; said slide-rod having two ends; and a mechanism for locating from the chassis either (a) the platen, or (b) the carriage and slide-rod, or (c) both; said mechanism comprising, for each of said platen, or carriage-and-slide-rod, or both, with respect to at least one of said ends of the slide-rod:

exactly two positive stops for use in locating said platen, or said carriage and slide-rod, or both, relative to the chassis; and an endcap for forcibly abutting said platen, or said carriage and slide-rod, or both, against, selectively, either of the positive stops.

2. Inkjet printing apparatus for forming an image on a printing medium as an array of inkdrops; said apparatus comprising:

a chassis;

a platen for supporting such printing medium from the chassis;

an inkjet printhead for ejecting such inkdrops;

a printhead carriage, and a carriage slide-rod, for supporting the printhead from the same chassis; said slide-rod having two ends; and a mechanism for locating from the chassis either (a) the platen, or (b) the carriage and slide-rod, or (c) both; said mechanism comprising, for each of said platen, or carriage-and-slide-rod, or both, with respect to at least one of said ends of the slide-rod:

exactly two positive stops for use in locating said platen, or said carriage and slide-rod, or both, relative to the chassis; and an endcap for forcibly abutting said platen, or said carriage and slide-rod, or both, against, selectively, either of the positive stops; and wherein:

the positive stops comprise a pair of hard surfaces respectively defined in the chassis; and the endcap biases the rod against, selectively, one of the pair of hard surfaces.

3. The apparatus of claim 2, wherein:

the slide-rod has two ends; and each end of the slide-rod has an associated pair of stops defined in the chassis, and an associated endcap.

4. The apparatus of claim 3, wherein:

a pivot point is defined in the chassis; and the endcap grips one end of the slide-rod, pivots about the chassis pivot point, and has two stable positions.

5. The apparatus of claim 4, wherein:

a biasing tab and a fastener aperture are defined in the chassis; and the endcap further comprises a resilient lever arm for engaging the biasing tab and a fastener loop for cooperating with the fastener aperture to secure the endcap firmly in either of its two stable positions.

6. The apparatus of claim 2, wherein:

the platen has locating bosses which are located substantially directly to the chassis.

7. Inkjet printing apparatus for forming an image on a printing medium as an array of inkdrops; said apparatus comprising:

a chassis;

first means for supporting such printing medium from the chassis;

an inkjet printhead for ejecting such inkdrops;

second means for supporting the printhead from the same chassis; and a mechanism for locating at least one of the first and second supporting means from the chassis, said mechanism having at least two ends and comprising, for each of said at least one supporting means, with respect to at least one of said two ends:

exactly two positive stops for use in locating said at least one supporting means relative to the chassis; and locking means for forcibly abutting said at least one supporting means against, selectively, either of the positive stops.

8. The apparatus of claim 7, wherein:

the second supporting means comprise a printhead carriage, and a carriage slide-rod; and the locating mechanism comprises means for locating from the chassis the second supporting means and the carriage slide-rod.

9. Inkjet printing apparatus for forming an image on a printing medium as an array of inkdrops; said apparatus comprising:

a chassis;

first means for supporting such printing medium from the chassis;

an inkjet printhead for ejecting such inkdrops;

second means for supporting the printhead from the same chassis; and a mechanism for locating at least one of the first and second supporting means from the chassis, said mechanism having at least two ends and comprising, for each of said at least one supporting means, with respect to at least one of said two ends:

exactly two positive stops for use in locating said at least one supporting means relative to the chassis; and locking means for forcibly abutting said at least one supporting means against, selectively, either of the positive stops; and wherein:

the second supporting means comprise a printhead carriage, and a carriage slide-rod; and the locating means comprise means for locating the second supporting means and the carriage slide-rod;

the positive stops comprise a pair of hard surfaces respectively defined in the chassis; and the locking means comprise a device that biases the rod against, selectively, one of the pair of hard surfaces.

10. The apparatus of claim 9, wherein:

the slide-rod has two ends; and each end of the slide-rod has an associated pair of stops defined in the chassis, and associated locking means.

11. The apparatus of claim 10, wherein:

the locking means respectively associated with the two ends of the slide-rod are mutually independently operable.

12. The apparatus of claim 9, wherein:

the slide-rod has a diameter;

an orifice, having a transverse dimension larger than the slide-rod diameter, is defined in the chassis; and opposite edges of the orifice are said pair of hard surfaces.

13. The apparatus of claim 12, wherein:

the orifice is substantially circular, and of diameter larger than the slide-rod diameter by an overall clearance on the order of one quarter millimeter (one hundredth inch).

14. The apparatus of claim 9, wherein:

a pivot point is defined in the chassis; and the locking-means device comprises an endcap that grips one end of the slide-rod, pivots about the chassis pivot point, and has two stable positions.

15. The apparatus of claim 14, wherein:

the locking-means device further comprises means for securing the endcap firmly in either of its two stable positions.

16. The apparatus of claim 9, wherein:

the first supporting means comprise a platen mounted to the chassis; and the platen has locating features which are located substantially directly to the chassis.

17. In an inkjet printer for forming an image on a printing medium as an array of inkdrops discharged from an inkjet printhead, an accurate system for establishing and adjustably controlling printhead-to-printing-medium spacing with no need for an assembly fixture; said apparatus comprising:

a first support for such printing medium;

a second support for such printhead; and an adjustable mechanism, distinct from the first and second supports, for locating the second support with respect to the first support; and wherein:

said mechanism comprises means for enabling adjustment of the mechanism and for controlling the spacing between the printhead and the printing medium without contributing uncertainty to said spacing.

18. The system of claim 17, wherein:

the first support comprises a platen;

the second support comprises a printhead carriage supported for sliding motion along a slide-rod; and the mechanism locates the slide-rod with respect to the platen.

19. The system of claim 18, further comprising:

a chassis, and wherein:

the platen is located substantially directly from the chassis; and the mechanism comprises means for locating the slide-rod substantially directly from the same chassis.

20. In an inkjet printer for forming an image on a printing medium as an array of inkdrops discharged from an inkjet printhead, an accurate system for establishing and adjustably controlling printhead-to-printing-medium spacing with no need for an assembly fixture; said apparatus comprising:

a chassis;

a first support for such printing medium;

a second support for such printhead; and an adjustable mechanism, distinct from the first and second supports, for locating the second support with respect to the first support; and wherein:

the mechanism comprises means for enabling adjustment of the mechanism and for controlling the spacing between the printhead and the printing medium means without contributing uncertainty to said spacing;

the first support comprises a platen;

the second support comprises a printhead carriage supported for sliding motion along a slide-rod; and the mechanism locates the slide-rod with respect to the platen;

the platen is located substantially directly from the chassis; and the mechanism comprises means for locating the slide-rod substantially directly from the same chassis; and further comprising:

formed in the chassis, a pair of opposed positive stops at opposite sides of the slide-rod, and a pivot point;

mounted to the chassis for rotation about the pivot point, a retainer that has a fitting for gripping an end of the slide-rod to move the end of the slide-rod toward either of the positive stops;

a toggling boss, also formed in the chassis, for restricting the retainer to two rotational positions wherein the retainer holds the slide-rod firmly against either of the positive stops; and a fastener for securing the retainer in one of the two rotational positions.

21. The system of claim 20, wherein:

the retainer also has an elongated resilient arm with an end, remote from the pivot point, for engaging the boss in said two rotational positions; and in either of the rotational positions the resilient arm bends slightly, developing restoring force to bias the slide-rod against a corresponding one of the stops.

22. The system of claim 20, wherein:

the printhead carriage comprises at least one bushing that is insert-molded into the carriage; and each bushing slides along the slide-rod.

23. A method for manufacturing an inkjet printer that has a printhead, movably supported along a slide-rod, for directing inkdrops to a printing medium that is supported from a chassis, said slide-rod having two ends and said chassis having two oversize mounting holes for holding respective ends of the slide-rod, said method comprising the steps of:

positioning the slide-rod with its two ends in the oversize mounting holes respectively;

attaching to each end of the slide-rod a respective retainer that forces the slide-rod end in one of exactly two opposite directions against the mounting-hole edge; and orienting the retainer to force the slide-rod end in a particular one of the two opposite directions.

24. The method of claim 23, further comprising the step of:

then securing the retainer to maintain the slide-rod end in said particular one direction.

25. The method of claim 23, further comprising the steps of:

then measuring the printhead-to-printing-medium spacing; and then, if and only if the measured spacing is displaced in magnitude in a particular polarity and by an unacceptably large amount from a nominal spacing magnitude, reorienting the retainer to force the slide-rod end in the direction opposite to said particular one of the directions.

26. The method of claim 25, wherein:

the printhead ejects inkdrops downward toward the printing medium;

orienting the retainer in said particular direction positions the slide-rod and printhead slightly below a nominal position, to establish a printhead-to-printing-medium spacing that is slightly less than the nominal spacing;

said particular polarity of displacement from nominal is toward even smaller values of spacing; and if the measured spacing is unacceptably small, then the retainer-reorienting step comprises forcing the slide-rod and printhead upward to increase the printhead-to-printing-medium spacing.

* * * * *

UNITED STATES PATENT AND TRADEMARK OFFICE

CERTIFICATE OF CORRECTION

PATENT NO. : 6,027,264

DATED : February 22, 2000

INVENTOR(S) : Edward P. Maher. et al.

It is certified that error appears in the above-indentified patent and that said Letters Patent is hereby corrected as shown below:

In the Abstract, line 9, after "respectively.", insert --In other words at least one of the two support elements is located using a respective set of exactly two positive stops.--.

In the Abstract, line 25, after "edge", insert --The retainer is oriented to force the slide-rod end in a particular one of the directions. The stops preferably include a pair of hard surfaces (preferably opposite edges of an orifice) defined in the chassis.--.

Signed and Sealed this

Third Day of April, 2001

Nicholas P. Godici

*Attest:*

NICHOLAS P. GODICI

*Attesting Officer*

*Acting Director of the United States Patent and Trademark Office*